US007874695B2

(12) United States Patent
Jensen

(10) Patent No.: US 7,874,695 B2
(45) Date of Patent: Jan. 25, 2011

(54) ELECTRICAL ACTUATOR SYSTEM FOR ARTICLES OF FURNITURE

(75) Inventor: Svend Erik Knudsen Jensen, Vejle (DK)

(73) Assignee: Linak A/S, Nordborg (DK)

( * ) Notice: Subject to any disclaimer, the term of this patent is extended or adjusted under 35 U.S.C. 154(b) by 202 days.

(21) Appl. No.: 11/984,333

(22) Filed: Nov. 15, 2007

(65) Prior Publication Data

US 2008/0127419 A1 Jun. 5, 2008

(30) Foreign Application Priority Data

Nov. 15, 2006 (DK) ..... 2006 01497

(51) Int. Cl.
*F21V 33/00* (2006.01)

(52) U.S. Cl. ..... 362/130; 362/129

(58) Field of Classification Search ..... 362/130, 362/127–129, 131–134; 5/616, 617–619, 5/666, 905, 906
See application file for complete search history.

(56) References Cited

U.S. PATENT DOCUMENTS

| | | | | |
|---|---|---|---|---|
| 2,185,051 | A | 12/1939 | Daigle | |
| 3,728,606 | A | 4/1973 | Finnegan et al. | |
| 4,149,222 | A | 4/1979 | Linde | |
| 4,472,845 | A | 9/1984 | Chivetta et al. | |
| 4,544,993 | A | 10/1985 | Kirk | |
| 4,947,298 | A | 8/1990 | Stephen | |
| 5,205,004 | A * | 4/1993 | Hayes et al. | 5/611 |
| 5,307,051 | A | 4/1994 | Sedlmayr | |
| 5,422,623 | A | 6/1995 | Bader et al. | |
| 5,644,291 | A | 7/1997 | Jozwik | |
| 5,743,635 | A | 4/1998 | Hulse et al. | |
| 5,802,640 | A | 9/1998 | Ferrand et al. | |
| 6,234,642 | B1 | 5/2001 | Bokämper | |
| 6,539,566 | B1 | 4/2003 | Hayes | |
| 6,595,654 | B2 * | 7/2003 | Washburn | 362/130 |
| 2008/0195776 | A1 | 8/2008 | Jensen | |

FOREIGN PATENT DOCUMENTS

| | | |
|---|---|---|
| JP | 8010101 | 1/1996 |
| JP | 8038311 | 2/1996 |
| JP | 2002008876 | 1/2002 |

OTHER PUBLICATIONS

English Abstract of JP 8010101.
English Abstract of JP 8038311.
English Abstract of JP 2002008876.

* cited by examiner

*Primary Examiner*—Sharon E Payne
(74) *Attorney, Agent, or Firm*—Dykema Gossett PLLC

(57) ABSTRACT

An electrical actuator system, especially for hospital and care beds and patient beds, comprising a number of actuators (6,7; 10,11), a control box (12) with a mains-based power supply, and typically also a rechargeable battery package and a control unit with a microprocessor, a number of controls (15,16), an orientation light (17) for mounting under the bed. The system comprises at least one junction box (13,14) and the orientation lighting is, with its own control unit, located in this. This enables a flexible location of the lighting.

3 Claims, 2 Drawing Sheets

ELECTRICAL ACTUATOR SYSTEM FOR ARTICLES OF FURNITURE

BACKGROUND OF THE INVENTION

1. Field of the Invention

The invention relates to an electrical actuator system for articles of furniture, especially for hospital and care beds and treatment couches, and comprising a number of actuators for bringing about the adjustment of the piece of furniture, a control box connected to the actuator(s) with a mains-based power supply and typically also a rechargeable battery package and a control unit, a number of controls with a number of control buttons, and an orientation light for mounting on the piece of furniture.

2. The Prior Art

The orientation lighting (Under Bed Light) on hospital and care beds are used, partly by the patients to find their bearings, when getting out of the bed in darkness and partly by the staff in order to find their bearings without having to switch on the main light in the room.

As an example of a bed with orientation lighting U.S. Pat. No. 6,234,642 B1 Dewert Antriebs-und Systemtechnik GmbH & Co. KG. can be mentioned. Herein is described a hospital and care bed where each drive for adjusting the bed is equipped with a control unit each. The orientation lighting is built into the control units.

As an example of other orientation lighting on beds can be referred to JP-U-5-93305, where several light sources are located around the bed. Another example is JP-A-8-38311, where a light source is placed in each corner of the bed. WO 00/33785 Huntleigh Technology Inc. mentions briefly the location of an orientation lighting in a central housing, under the bed, comprising all actuators for adjusting the bed.

The object of the invention is to provide an actuator system for articles of furniture as described by way of introduction with a more flexible location of the orientation lighting.

SUMMARY OF THE INVENTION

The actuator system according to the invention is characterized in that it comprises at least one junction box and that the orientation lighting is located in this with a separate control unit. This allows a more flexible location of the orientation lighting. Typically, the actuator system has just one control box comprising a mains-based power supply and a rechargeable battery package, so that the bed may be adjusted even though it is temporarily not connected to mains. Moreover, the control box comprises the control unit. All the actuators are connected to the control box. In some actuators a part of the control unit may be located in the actuators, while the rest of the control unit is located in the control box. The junction box(es) is/are cable connected to the control box. Hand controls and/or control panels and other equipment are connected to the junction boxes, but is should be understood that it does not exclude that certain hand controls, control panels or other equipment may be directly connected to the control box. As the junction box(es) is/are cable connected to the control box, said control box and thereby the orientation lighting may be placed as desired. As the orientation lighting is constructed with a separate control unit in the junction box, it is independent of the other control unit in the system. The orientation lighting can for instance be switched on all the time which of course results in a continued energy consumption, but when using light diodes as light source, this is minimal. Alternatively, it may be switched on and off via a separate switch on the junction box or via one of the controls. Another possibility is a light sensitive switch, which automatically switches on the orientation lighting when the light level in the room falls below a certain intensity.

An embodiment of the actuator system according to the invention will be described further in the following with reference to the accompanying drawings.

DETAILED DESCRIPTION OF THE PREFERRED EMBODIMENT

Figure 1:
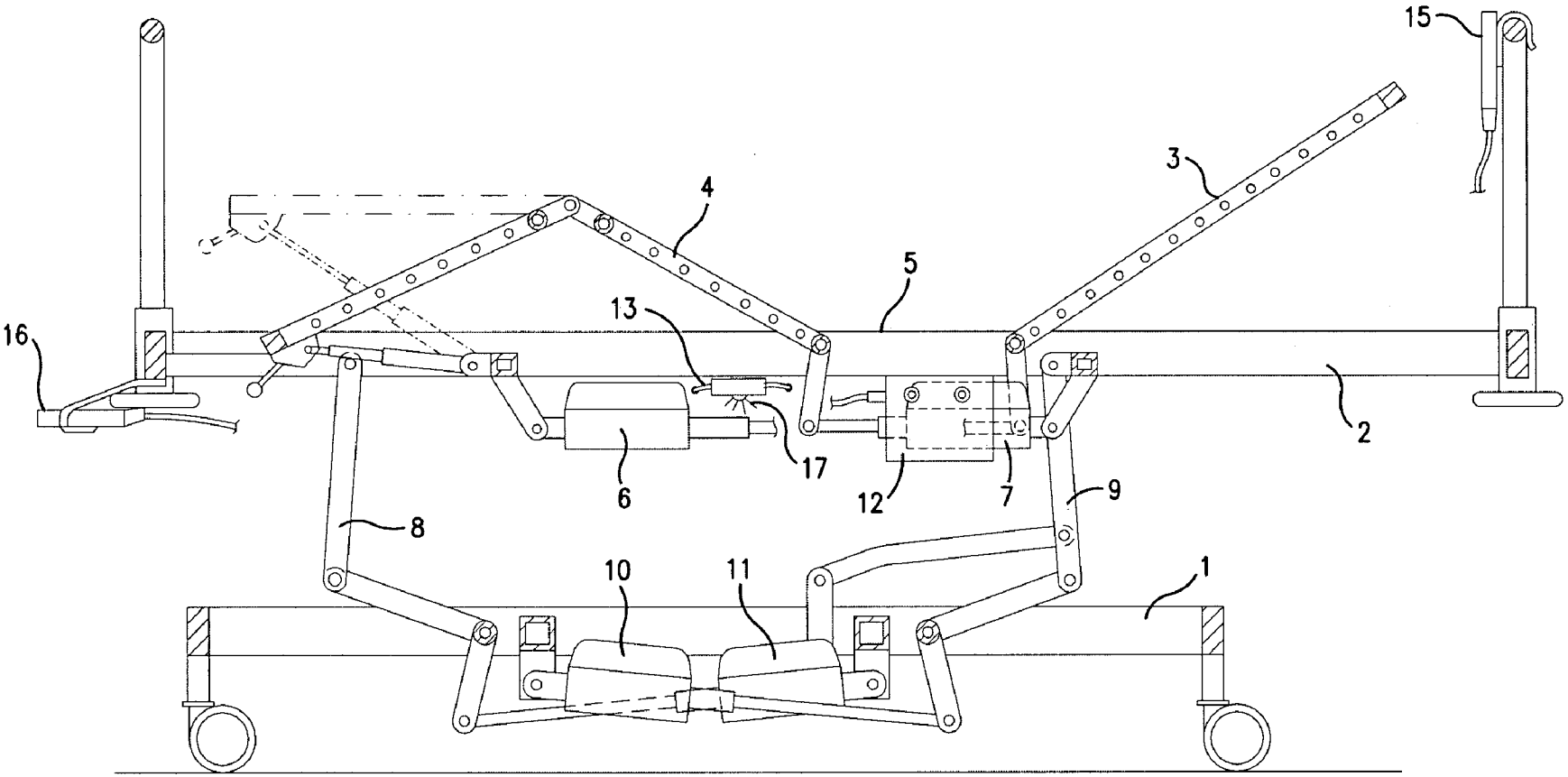
FIG. 1 shows a schematic view of a hospital bed.
Figure 2:
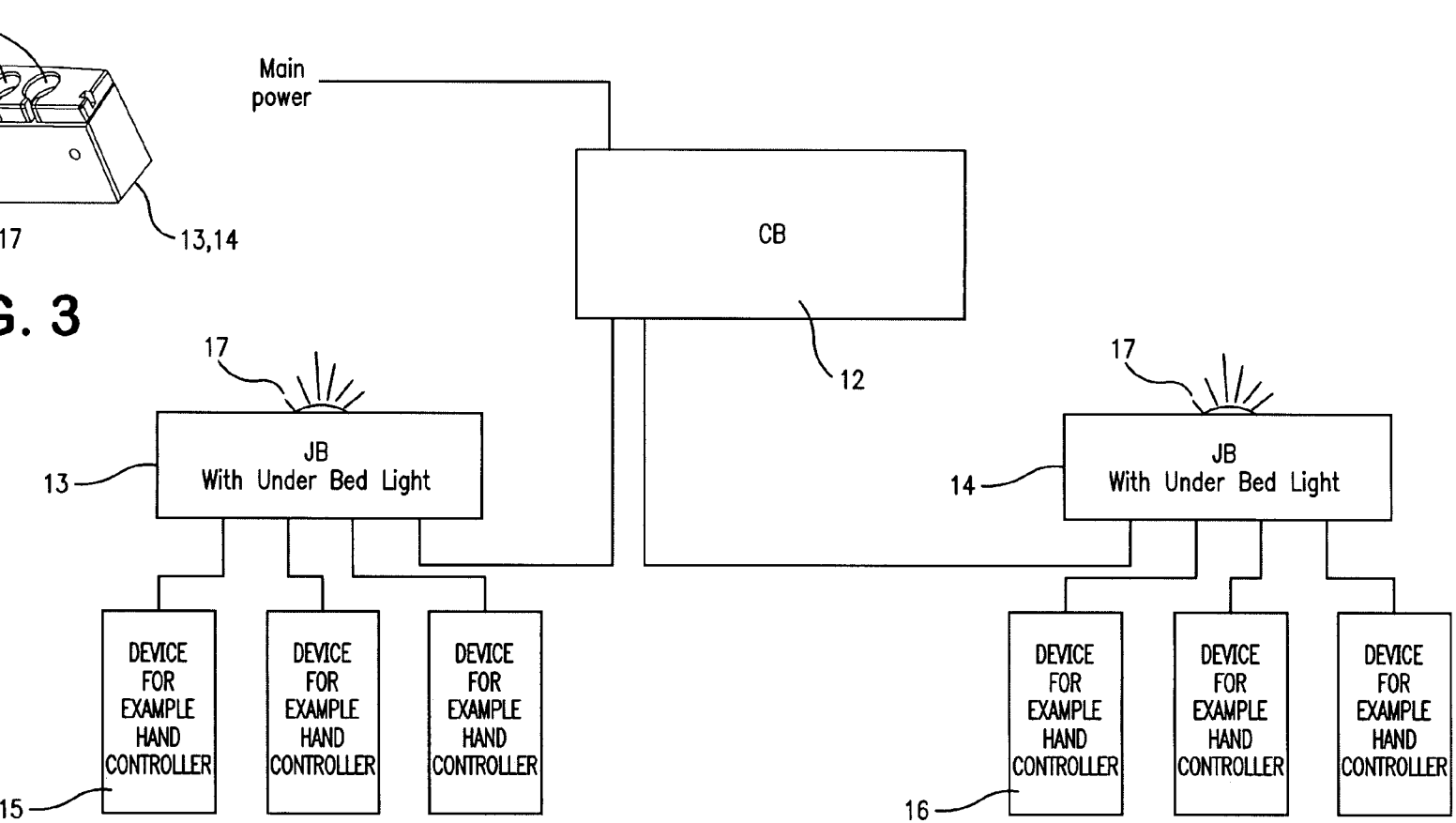
FIG. 2 shows a block diagram of the actuator system, but shown without actuators.

The hospital bed shown in FIG. 1 of the drawing comprises a lower frame 1 equipped with drive wheels and an upper frame 2. On the upper frame 2 is mounted an adjustable support for a mattress. The support comprises a back rest section 3, an articulated leg rest section 4 and a fixed middle section 5 between these. The back rest and leg rest section 3,4 can be adjusted by means of a respective actuator 6,7 so that the support may assume various contours. The upper frame 2 is coupled to the lower frame 1 with a link connection 8,9 at respective ends. The upper frame 2 may be raised and lowered by means of two actuators 10,11 coupled to the link connections. The actuators are connected to a control box 12 comprising a power supply for connection to mains, a rechargeable battery package and a control unit. Here, a bus system as described in WO2007/057014 A1 LINAK A/S is expediently used, which is hereby made part of the present application.

To the control box 12 are connected two junction boxes 13,14 for connection of controls such as hand controls 15,16, fixed control panels in bed guards (not shown in FIG. 1) and any other periphery equipment.

Figure 3:
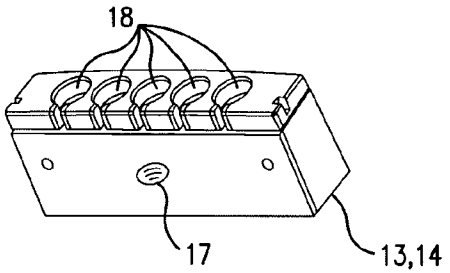
FIG. 3 shows a junction box.

As orientation lighting under the bed, a diode lighting 17 with a separate control unit and which can be switched on or off via one or more of the controls 15,16 is mounted in the junction boxes 13,14. As it appears from FIG. 3, the junction boxes are lengthy box-shaped housings with a number of sockets 18 for plugs connected to a distribution print, which at the same time comprises the control unit for the orientation lighting. The diode lighting is energized via the power supply in the control box. The junction boxes 13,14 are mounted under the upper frame 2, one at each side of the bed and arranged so that the diode lighting faces downwards, thus directing the light towards the floor.

Even though the invention in the above is described in connection with a bed, it is understood that the invention may also be employed in connection with other adjustable pieces of furniture such as arm chairs and desks.

The invention claimed is:

1. An electrical actuator system for an article of furniture, comprising a plurality of actuators for adjusting the article of furniture, a single control box connected to the actuator(s) with a mains-based power supply and a rechargeable battery package and at least a part of a control unit, a number of controls with a number of control buttons, and at least one junction box for mounting on the article of furniture and connected to the control box, each said junction box containing an orientation light with a separate control unit.

2. The electrical actuator system according to claim 1, comprising two junction boxes.

3. The electrical actuator system according to claim 1, wherein each orientation light comprises one or more light diodes.

* * * * *